United States Patent [19]

Haydock

[11] 4,079,912

[45] Mar. 21, 1978

[54] ADJUSTABLE CORE FORMS

[76] Inventor: Charles Edward Haydock, 390 Ridgefield Rd., Wilton, Conn. 06897

[21] Appl. No.: 744,140

[22] Filed: Nov. 22, 1976

[51] Int. Cl.[2] ..... B28B 7/30; E04G 17/06

[52] U.S. Cl. ..... 249/184; 249/43; 249/217

[58] Field of Search ..... 249/40–46, 249/190–191, 213–214, 216–217, 183–184, 186; 52/705–706

[56] References Cited

U.S. PATENT DOCUMENTS

| | | | |
|---|---|---|---|
| 938,073 | 10/1909 | Percival | 52/705 |
| 1,311,036 | 7/1919 | Birch | 249/43 |
| 3,276,176 | 10/1966 | Jonsson et al. | 52/706 |
| 3,744,208 | 7/1973 | Spanel | 52/706 |

*Primary Examiner*—Francis S. Husar
*Assistant Examiner*—John McQuade
*Attorney, Agent, or Firm*—McCormick, Paulding & Huber

[57] ABSTRACT

An adjustable molding form comprises axially elongated male and female form elements made from severable plastic material. Each element has a thin-walled shell of uniform wall thickness which defines internal and external helical screw threads. The female form element has one end wall and is open at its opposite end, whereas the male form element has a pair of end walls and is threaded into the open end of the female form element. Coaxially aligned central openings in the end walls of the form elements cooperate with a rod or bolt member which extends therethrough to support the molding form at axially spaced intervals on the member.

6 Claims, 6 Drawing Figures

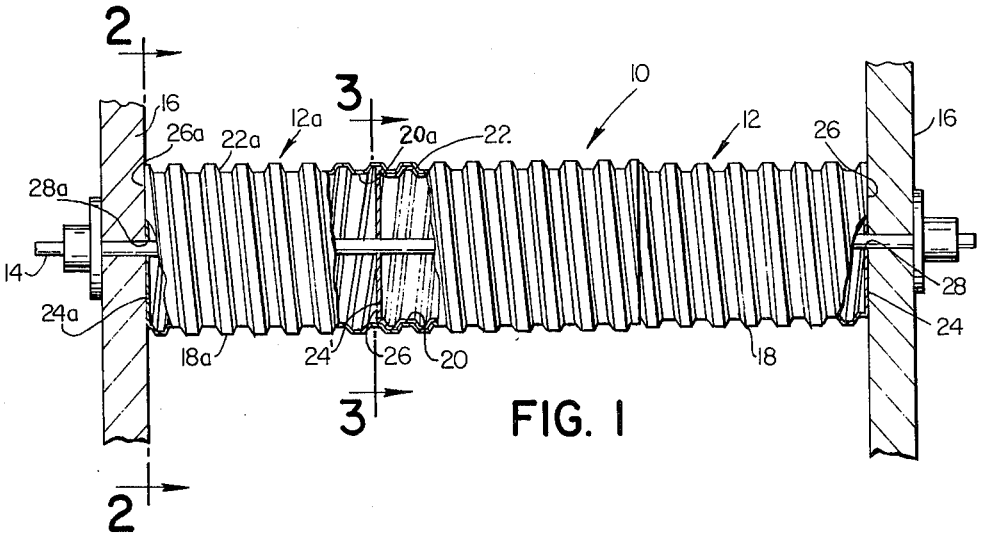
FIG. 1
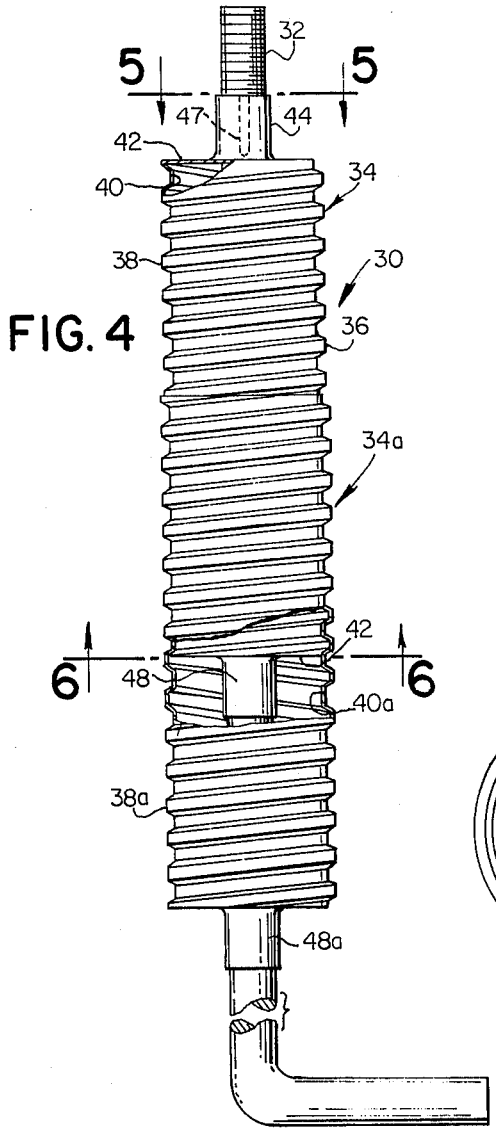
FIG. 4
FIG. 2
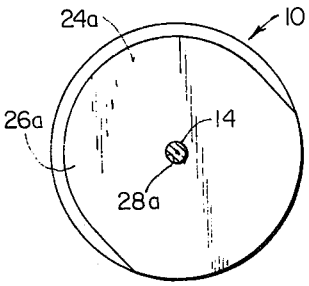
FIG. 3
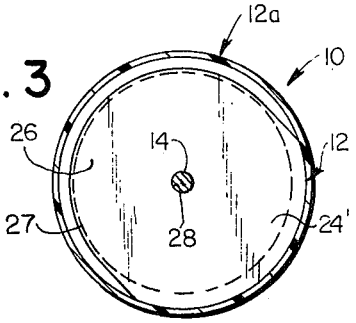
FIG. 5
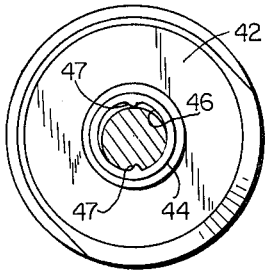
FIG. 6
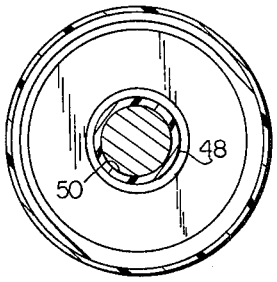

ADJUSTABLE CORE FORMS

BACKGROUND OF THE INVENTION

This invention relates in general to molding forms of the type used to produce voids in molded structures such as concrete walls, foundations, and the like, and deals more particularly with improved adjustable forms of the latter type. The general aim of the present invention is to provide improved expendable molding forms for low cost manufacture and which may be accurately adjusted to desired length at a job site for positioning on tie rods, anchor bolts, and like members.

SUMMARY OF THE INVENTION

In accordance with the present invention an improved adjustable molding form is provided which comprises axially elongated male and female form elements made from severable plastic material. Each form element comprises a generally cylindrical thin-walled shell of uniform wall thickness and has a side wall which defines internal and external screw threads which extend the entire axial length of the side wall and define the maximum radial extent of the form element. The male element has at least one end wall and may have end walls at both of its ends, whereas the female element has a single end wall and is open at its opposite end and threadably receives the mal element therein. Coaxially aligned central openings are provided in the end walls of the male and female form elements to receive a rod or bolt therethrough.

BRIEF DESCRIPTION OF THE DRAWINGS

FIG. 1 is a side elevational view of an adjustable molding form embodying the present invention and shown supported on a pencil rod between a pair of wall forms, the wall forms being shown in section.

FIG. 2 is a somewhat enlarged sectional view taken along the line 2—2 of FIG. 1.

FIG. 3 is a somewhat enlarged sectional view taken along the line 3—3 of FIG. 1.

FIG. 4 is a side elevational view of another adjustable molding form embodying the invention and shown positioned on an anchor bolt.

FIG. 5 is a somewhat enlarged sectional view taken along the lines 5—5 of FIG. 4.

FIG. 6 is a somewhat enlarged sectional view taken along the line 6—6 of FIG. 4.

DETAILED DESCRIPTION OF PREFERRED EMBODIMENTS

Turning now to the drawing and referring first particularly to FIGS. 1-3, an adjustable molding form embodying the present invention and indicated generally by the reference numeral 10 comprises telescopically connected male and female form elements indicated generally at 12 and **12*a*, respectively. The illustrated molding form 10 is particularly adapted for use in producing a void in a molded concrete wall, or the like, and is shown supported on a pencil rod 14 which connects a pair of wall forms 16, 16. The rod 14 extends through the molding form 10 and through the wall forms 16, 16, has conventional fasteners secured to its opposite ends, and ties the wall forms together in spaced relation with the molding form 10** therebetween, substantially as shown.

Considering now the illustrated molding form 10 in further detail, each of the form elements 12 and 12a is made from severable plastic material and comprises a generally cylindrical thin-walled shell of uniform wall thickness, which defines internal and external helical screw threads. The male element 12 has a side wall 18 which defines internal and external screw threads indicated at 20 and 22, respectively. The threads extend throughout the entire length of the male form element and define its maximum radial extent. The thread form may vary, however, the illustrated form elements are provided with Acme Standard Threads. The male element has at least one integral end wall. However, the illustrated element 12 has a pair of integral end walls 24, 24' which form closures for its opposite ends and define its maximum axial extent. Each end wall 24 has a substantially planar radially disposed and axially outwardly facing bearing surface 26 for abutting face-to-face engagement with a surface of a wall form, or the like, such as a form 16. One end wall 24' has a circular line of weakening or perforation 27, shown in FIG. 3, which generally separates it from the remainder of the male element 12. The opposite end walls 24, 24' have coaxially aligned circular central openings 28, 28 therethrough, the diameter of each opening 28 being substantially equal to the diameter of a cylindrical pencil rod to be received therethrough.

The female form element **12*a* is similar to the male element 12 previously described, but is of a slightly larger diameter. It has a side wall 18*a* which defines an internal screw thread 20*a* and an external screw thread indicated at 22*a*. An integral end wall 24*a* forms a closure for one end of the female form element 12*a* which is open at its opposite end. A circular central opening 28*a* formed in the end wall 24*a* is substantially equal in diameter to the circular openings 28, 28 in the male form element 12. The female form element 12*a* is adapted to be threaded onto the male form element 12, consequently the internal thread 20*a* is arranged to complement the external thread 22 on the male form element. It will now be evident that the female form element 12*a* may, for example, be formed from another male element of slightly larger diameter than the male element 12** and from which one end portion has been severed.

The axial length of the molding form 10 is axially adjustable through a relatively wide range for use in forming voids in wall slabs of various thickness. The molding form 10 is adjusted by rotating one of the elements **12, 12*a* relative to the other so that the opposite end walls of the molding form will abut the wall forms between which it is to be supported. The circular openings 28, 28 and 28*a* closely surround the pencil rod 14 which extends therethrough. The inner end wall 24 on the male form element cooperates with the rod to support the form 10 intermediate its ends and to maintain the elements 12 and 12*a* in substantially coaxial alignment even when heavy molding material, such as concrete, is poured into the space between the wall forms 16, 16 over the form 10. When the molding material has solidified and cured, the wall forms 16, 16 may be removed in a conventional manner exposing end walls 24 and 24*a* at opposite ends of the form 10. If desired, the individual form elements 12 and 12*a* may be threaded out of engagement with each other and out of the molded wall structure, a knife may be used to cut away the opposite end walls 24 and 24*a*. Thereafter, a rod or the like may be used to knock out the end wall 24' causing it to separate from the remainder of the male element 12 along the line of weakening 27 to expose an opening or passageway through the molding form 10 and thence through the molded wall. If the opening through the wall is to be filled with molding material or grout the internal threads on the form 10 or the grooves formed in the wall by the external threads on the form 10**, serve to anchor the filling material so that it cannot be dislodged from the wall structure.

In FIGS. 4–6 of the drawing another adjustable molding form embodying the present invention is illustrated and indicated generally by the reference numeral 30. The molding form 30 comprises an anchor bolt sleeve and is particularly adapted for adjustable axial positioning on an anchor bolt and for further adjustment to desired axial length. The adjustable bolt sleeve 30 is shown attached to a typical anchor bolt 32 of a type adapted to be embedded in a concrete foundation or like structure and comprises a male form element indicated generally by the numeral 34 and a female form element indicated generally at 34*a*. The form elements 34 and 34*a* are similar in many respects to the elements 12 and 12*a* previously described and comprise generally cylindrical hollow thin-walled shells of substantially uniform wall thickness. The male element 34, which is connected to the upper end of the bolt 32, has a side wall 36 which defines internal and external screw threads respectively indicated at 38 and 40. The male element 34 also has end walls 42, 42 at its opposite ends. A generally cylindrical neck portion 44, projects axially upwardly from the upper end wall 42, and defines coaxially aligned central bore opening 46 which has a diameter at least equal to the diameter of the bolt 32 for receiving the threaded upper end of the bolt. The neck portion 44 has an axially extending rib 47 which projects radially into the central bore opening 46 for engaging the threads on the bolt 32. Preferably, and as shown, the male form element also has another generally cylindrical neck portion 48 which projects from the lower end wall 42 and which as a smooth central cylindrical bore opening 50 for slidably receiving the bolt 32 therethrough.

The female form element 34a is similar to the male form element 34 previously described and is or may be a male element substantially identical to the male element 34, but of slightly larger diameter, and from which the upper end wall 42 and the neck portion 44 has been severed.

The bolt 32 is inserted through the bolt sleeve 30 so that the male element 34 is at the upper or threaded end of the bolt. Force is applied to the bolt 32 in the direction of the neck portion 44 so that the male threads on the bolt cut into the rib 47 to form a complementary female thread on the rib whereby to facilitate axial adjustment of the male form element relative to the bolt 32. After preliminary adjustment of the bolt sleeve 30 relative to the bolt, the female form 34*a* may be rotated relative to the male form 34 to adjust the axial length of the form to desired length relative to the bolt. Preparatory to pouring a foundation, floor slab or the like, the bolt 32 with the adjusted sleeve 30 thereon, is tied or otherwise secured in position to resist lateral movement so that concrete or other molding material may be poured around the lower end of the bolt and around the sleeve 30. The neck portion 48 at the lower end of the male form 34 surrounds the bolt 32 intermediate the ends of the sleeve 30 and cooperates with the bolt to prevent the elongated two-part form from moving laterally relative to the bolt when heavy molding material such as concrete is poured therearound.

After the concrete has hardened and cured the male form element 34 may, if desired, be removed from the molded structure in which it is embedded whereby to expose a void within the molded structure and between the bolt shank and the inner wall of the female form element 34*a*. The upper wall 42 is first severed from the threaded side wall of the male element 34 so that the upper neck portion 44 may be threaded off of the bolt 32 and the remainder of the male element may be threaded out of the molded structure. If desired, the male element may be allowed to remain in the molded structure. The upper end wall 42 may be severed from the remainder of the element by cutting it away with a knife, and the upper neck portion 44 may be threaded off of the bolt to expose a void within the male element 34 between the inner wall of the element and the bolt shank. In like manner, an elongated cutting tool may be employed to sever the lower end wall of the male element 34 therefrom so that it too may be removed to provide access to the void at the lower end of the sleeve 30. In some instances, it may be desirable to sever the lower end wall from the male element before it is assembled with the female element to form a bolt sleeve.

Where a form of greater axial length than the form 10 may be required, both ends may be severed from the female form element 12a and a second male element 12 may be connected thereto, the female element 12a comprising a connecting member between a pair of male elements 12, 12. In like manner, two male elements 34, 34 may be joined together by a female element 34a to form an elongated bolt sleeve, however, where this arrangement is desired the upper neck portion 44 must be severed from the lower male form element 34 to remove the thread engaging rib whereby to permit free passage of a bolt upwardly therethrough.

I claim:

1. An adjustable molding form assembly comprising axially elongated male and female form elements made from severable plastic material, each of said elements comprising a generally cylindrical thin-walled shell of uniform wall thickness and including a side wall defining internal and external screw-threads extending the entire axial length thereof and defining the major radial extent thereof, said male element having at least one end wall providing a substantial closure for at least one end thereof, said female element having one end wall and being open at its other end, the end walls of said elements having coaxially aligned central openings therethrough, said male element being received within said other end of said female element in threadable engagement with said female element.

2. An adjustable molding form assembly as set forth in claim 1 wherein said male element has a pair of end walls providing substantial closures for the opposite ends thereof.

3. An adjustable molding form assembly as set forth in claim 2 wherein each of said end walls on said male form element and said one end wall on said female form element has a radially disposed bearing surface, said end walls of said male element define the axial extent of said male form element and said one end wall of said female element and said other end thereto define the axial extent of said female form element.

4. An adjustable molding form assembly as set forth in claim 2 wherein said male form element has at least one integral cylindrical neck portion of reduced diameter extending coaxially outwardly from one of said end walls and defining one of said central openings.

5. An adjustable molding form assembly as set forth in claim 4 wherein said one neck portion has an integral axially extending rib thereon projecting into the central opening defined thereby.

6. An adjustable molding form assembly as set forth in claim 2 wherein at least one of said end walls of said male element has a circular line of weakening thereon along which said one end wall of said male element may be separated from the remainder of said male element.

* * * * *

UNITED STATES PATENT OFFICE

CERTIFICATE OF CORRECTION

Patent No. 4,079,912 Dated March 21, 1978

Inventor(s) Charles E. Haydock

It is certified that error appears in the above-identified patent and that said Letters Patent are hereby corrected as shown below:

Column 1, line 28, "mal" should be --male--

Column 2, line 55, after "the" insert --form--

Column 3, line 38, "as" should be --has--

Column 4, line 62, "thereto" should be --thereof--

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*